US008393910B2

(12) United States Patent
Matsumoto et al.

(10) Patent No.: US 8,393,910 B2
(45) Date of Patent: Mar. 12, 2013

(54) CARD CONNECTOR

(75) Inventors: Yasuyoshi Matsumoto, Yamato (JP); Mitsuhiro Tomita, Yamato (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 13/254,959

(22) PCT Filed: Mar. 5, 2010

(86) PCT No.: PCT/US2010/026303

§ 371 (c)(1),
(2), (4) Date: Sep. 6, 2011

(87) PCT Pub. No.: WO2010/102169

PCT Pub. Date: Sep. 10, 2010

(65) Prior Publication Data

US 2012/0009808 A1 Jan. 12, 2012

(30) Foreign Application Priority Data

Mar. 5, 2009 (JP) ..... 2009-052204
Mar. 5, 2009 (JP) ..... 2009-052388

(51) Int. Cl.
*H01R 13/62* (2006.01)

(52) U.S. Cl. ..... 439/159

(58) Field of Classification Search ..... 439/159
See application file for complete search history.

(56) References Cited

U.S. PATENT DOCUMENTS 7,435,115 B2 * 10/2008 Kiryu et al. ..... 439/159
2005/0208804 A1 9/2005 Kikuchi et al.
2007/0178733 A1 8/2007 Sadatoku
2007/0202750 A1 8/2007 Nishiwaki et al.

FOREIGN PATENT DOCUMENTS

EP 1 577 827 A1 9/2005

OTHER PUBLICATIONS

International Search Report for PCT/US2010/026303.

* cited by examiner

*Primary Examiner* — Phuong Dinh
(74) *Attorney, Agent, or Firm* — Timothy M. Morella

(57) ABSTRACT

A card connector comprises a housing, connection terminals, a card guide mechanism and a cover member. The housing is configured to accommodate therein a card which is provided with terminal members. The connection terminals are mounted in the housing and configured to be capable of coming into contact with the terminal members of the card. The card guide mechanism is provided with a slide member configured to slide while holding the card inserted into the housing, and an urging member configured to urge the slide member in a direction opposite to an insertion direction of the card. The cover member mounted on the housing and configured to cover at least the slide member and a portion of the card inserted into the housing.

15 Claims, 10 Drawing Sheets

CARD CONNECTOR

REFERENCE TO RELATED APPLICATIONS

The Present Application claims priority of prior-filed Japanese Patent Application Nos. 2009-052204, entitled "Card Connector," and filed 5 Mar. 2009, and 2009-052388, entitled "Card Connector," and filed 5 Mar. 2009, the contents of which are fully incorporated in their entireties herein.

BACKGROUND OF THE PRESENT APPLICATION

The Present Application relates, generally, to a card connector, and, more particularly, to a card connector having a braking force of an appropriate magnitude that can be constantly stably exerted at an appropriate timing regardless of the dimensional accuracy of the memory card, and thus, the card can be stably and certainly ejected at an appropriate speed while preventing the card from springing out from the card connector.

Typically, an electronic device is provided with a card connector in order to use a variety of memory cards. From the viewpoint of usability, recent card connectors typically have a push-push structure that requires an operation of pushing a memory card when the memory card is inserted therein and ejected therefrom. However, in a push-push type card connector, since the card is slid by a repulsive force of a spring generated when the card is ejected, the moving speed of the card or a slide member holding the card becomes rather high, so that there might occur an unfavorable state such that the card springs out of the card connector or the slide member collides against a stopper member and an impact is applied thereto. In this regard, a proposal has already been made to provide a technique that uses a decelerating device to decelerate the card or the slide member when the card is ejected. An example of a typical card connector is disclosed in Japanese Patent Application No. 2007-015039.

FIG. 10 is an exploded perspective view of a card connector according to the prior art. Referring to FIG. 10, a housing of a card connector, which is formed of an insulating material such as synthetic resin, is generally designated by reference numeral 811, and is provided with plurality of connection terminals 851 which is formed of metal. A shell of the card connector, which is formed of a metal plate, is generally designated by reference numeral 861, and is attached to an upper side of housing 811. Memory card 901 is inserted into a space defined between shell 861 and housing 811, so that non-illustrated contact pads of memory card 901 come into contact with corresponding connection terminals 851.

In the example illustrated in the drawing figure, the card connector is a so-called push-push type connector, and is provided with a guide mechanism for permitting ejection of memory card 901 therefrom. The guide mechanism is provided with slide member 821 configured to be engaged with memory card 901 to slide together with memory card 901 and coil spring 881 that urges slide member 821 in a direction for ejecting memory card 901.

Guide mechanism-accommodation groove portion 811*h* is formed in one side portion of housing 811, so that slide member 821 is slidably accommodated in guide mechanism-accommodation groove portion 811*h*. Cam groove 823 of a heart cam mechanism is provided on an upper surface of slide member 821, and one end of pin member 871 of the heart cam mechanism is provided to be engaged with cam groove 823. The other end of pin member 871 is provided for being locked in guide mechanism-accommodation groove portion 811*h* at a position in the vicinity of stopper portion 811*g*. Pin member 871 is held by being urged downward from an upper side by leaf spring member 865 of shell 861.

Slide member 821 is further provided with first engagement portion 821*c* configured to come into engagement with a front end of memory card 901, projecting portion 824 configured to come into engagement with a front end of convex engagement portion 911 of memory card 901, second engagement portion 821*d* configured to come into engagement with concave engagement portion 912 of memory card 901, and abutting portion 821*e* configured to come into contact with stopper portion 811*g* so as to stop slide member 821.

When a user inserts and pushes memory card 901 into housing 811, memory card 901 is pushed into an innermost side of housing 811. Then, first engagement portion 821*c*, projecting portion 824, and second engagement portion 821*d* of slide member 821 come into engagement with the front end, convex engagement portion 911, and concave engagement portion 912 of memory card 901, respectively. Slide member 821 is inwardly moved toward the innermost side of housing 811 together with memory card 901 while resisting against a repulsive force of coil spring 881. Further, when one end of pin member 871 is latched to cam groove 823 by the action of the heart cam to result in stopping of slide member 821, memory card 901 comes to stop there under a state where it is inserted into housing 811.

Next, when the user pushes memory card 901 to eject the memory card 901 out of housing 811, one end of pin member 871 is released from the state of being latched to cam groove 823. With this operation, slide member 821 is set free and is therefore moved toward the front side together with memory card 901 by the force exerted by coil spring 881, and thus, memory card 901 is ejected from housing 811.

Guide mechanism-accommodation groove portion 811*h* is formed, in a side wall thereof, with cantilever-like brake shoe 819 having restoring properties. Moreover, upwardly pressing springs 852R, 852L are arranged on both sides of plurality of connection terminals 851. A top surface of brake shoe 819 is pressed against a side surface of projecting portion 824 of slide member 821, and the upper surfaces of upwardly pressing springs 852R, 852L are pressed against a lower surface of memory card 901.

As a result, the moving speed of slide member 821 and memory card 901 is reduced by brake shoe 819 and upwardly pressing springs 852R, 852L when memory card 901 is ejected from housing 811. Therefore, memory card 901 is prevented from springing out of the card connector, and/or abutting portion 821*e* of slide member 821 is prevented from colliding against stopper portion 811*g* while mitigating occurrence of a shock.

Nevertheless, in the above-mentioned conventional card connector, since upwardly pressing springs 852R, 852L need to be provided as additional separate members, it may lead to an increase in the number of components and in the manufacturing cost. Moreover, in recent years, with the fast trend toward lowering the manufacturing cost, the finishing accuracy of the outline of memory card 901 tends to decrease and the dimensional accuracy of the top surface of memory card 901 also tends to decrease. That is to say, even an identical type of memory cards 901 often exhibits a change in thickness dimension thereof as well as in the degree of surface roughness or smoothness thereof. For this reason, if memory card 901 has a large thickness dimension, the pressing force of upwardly pressing springs 852R, 852L becomes stronger while causing an increase in a braking force beyond an expected value. As a result, the ejection of memory card 901 is apt to be prevented. On the other hand, if memory card 901 has a small thickness dimension, the pressing force of upwardly pressing springs 852R, 852L is weakened while reducing the braking force to a value below the expected value. As a result, memory card 901 may spring out from the card connector. Similarly, if the top surface of memory card 901 is rough, a large braking force beyond the expected value appears, so that the ejection of memory card 901 is prevented. On the other hand, if the top surface of memory card 901 is smooth, the braking force becomes smaller than the expected value, so that memory card 901 may spring out from the card connector.

Brake shoe 819 needs to be provided with the restoring properties and be formed into a cantilever-like shape in the side wall of guide mechanism-accommodation groove portion 811*h*. On the other hand, in recent years, with the rapid miniaturization of electronic devices or apparatuses, memory card 901 and card connectors have become rapidly miniaturized. For this reason, it may be extremely difficult to form brake shoe 819 having a very small size, capable of constantly exerting stable spring characteristics, and having an extremely complicated cantilever-like shape, in the side wall of guide mechanism-accommodation groove portion 811*h* of housing 811 that is manufactured by integral molding with an insulating material such as synthetic resin; even if possible, it must bring about an increase in the manufacturing cost.

SUMMARY OF THE PRESENT APPLICATION

Therefore, it is an object of the Present Application to solve the above-described problems encountered by the conventional card connector and to provide a card connector which is provided with such a configuration that a plurality of convex portions are formed on a top surface of a slide member configured to slide while holding a card, and a cantilever-like leaf spring member formed in a shell is intermittently brought into contact with a plurality of convex portions so as to apply a brake to the slide member. As a result, a braking force of an appropriate magnitude can be constantly stably exerted at an appropriate timing regardless of the dimensional accuracy of the card. Moreover, the card can be stably and certainly ejected at an appropriate speed while preventing the card from springing out from the card connector. Accordingly, the card connector can be easily produced to have a simple structure at a low cost with high reliability thereof without causing an increase in the number of components.

Therefore, in accordance with the Present Application, there is provided a card connector comprising: a housing configured to accommodate therein a card which is provided with terminal members; connection terminals mounted in the housing and configured to be capable of coming into contact with the terminal members of the card; a card guide mechanism which is provided with a slide member configured to slide while holding therein the card inserted into the housing and an urging member configured to urge the slide member in a direction opposite to an insertion direction of the card, and is configured to hold the card at a lock position thereof to thereby maintain a state where the terminal members of the card are in contact with the connection terminals, and when the card is moved in the insertion direction to reach an over-stroke position thereof by a pushing operation to push the card being held at the lock position in the insertion direction, to thereby move the card in the direction opposite to the insertion direction from the over-stroke position by an urging force of the urging member to be ejected therefrom; and a cover member mounted on the housing and configured to cover at least the slide member and a portion of the card inserted into the housing, wherein: the cover member is provided with a cantilever-like brake member which has a base end portion thereof being integrally connected to the cover member and a free end thereof being formed with a sliding portion; and the slide member is provided with a brake-receipt portion containing a braking face capable of permitting the sliding portion to be in close contact therewith, the braking face being formed therein with a plurality of convex portions which is arranged in the insertion direction of the card.

In accordance with another embodiment of the Present Application, the card connector has such a configuration that the braking face contains a top surface of each of the convex portions having a height thereof which changes in an order of low, high, low, high, and low in a direction from a front side in the insertion direction of the card toward an innermost side thereof.

In accordance with a further embodiment of the Present Application, the card connector has such a configuration that the braking force to apply a brake to the slide member, which generates when the sliding portion comes into close contact with the braking face, changes in the order of low, high, low, high, and low when the slide member moves in the direction opposite to the insertion direction of the card from the over-stroke position.

In accordance with a still further embodiment of the Present Application, the card connector has such a configuration that the brake member exerts an elastic force and the sliding portion is pressed against the braking face by the elastic force.

In accordance with a still further embodiment of the Present Application, the card connector has such a configuration that the sliding portion comes into close contact with a portion of the braking face being located closer to the front side in the insertion direction of the card than the convex portion that is positioned on the frontmost side when the card is positioned at the over-stroke position, and comes into tight contact with the top surface of the convex portion that is positioned on the frontmost side when the card is positioned at the lock position.

In accordance with a still further embodiment of the Present Application, the card connector has such a configuration that when the card is ejected, the slide member comes into tight contact with a stopper portion of the housing and stops, and when the slide member comes into tight contact with the stopper portion and stops, the sliding portion comes into close contact with a portion of the braking face being located closer to the innermost side in the insertion direction of the card than the convex portion that is positioned on the innermost side or comes to be positioned closer to the innermost side in the insertion direction of the card than the brake-receipt portion so as to be in no contact with the braking face.

In accordance with a still further embodiment of the Present Application, the card connector has such a configuration that when the card is ejected, so that the card is positioned at a position where the connection between the terminal members and the connection terminals is disrupted, the sliding portion comes into close contact with a portion of the braking face which is located between the convex portion that is positioned on the frontmost side and the convex portion that is positioned on the innermost side, and which is not provided with the convex portions.

In accordance with a still further embodiment of the Present Application, the card connector has such a configuration that when the card is ejected, so that the card is positioned between a position where the connection between the terminal members and the connection terminals is disrupted and a position where the slide member comes into tight contact with a stopper portion of the housing and stops, the sliding portion comes into close contact with a top surface of the convex portion that is positioned on the innermost side in the braking face.

In accordance with a still further embodiment of the Present Application, the card connector has such a configuration that the urging member comprises a coil spring capable of exerting an urging force upon being compressed.

In accordance with the Present Application, the card connector has such a configuration that a plurality of convex portions are formed on the top surface of the slide member configured to slide while holding a card, and the cantilever-like leaf spring member formed in the shell is intermittently brought into contact with a plurality of convex portions. Owing to the described configuration, an appropriate magnitude of braking force can be constantly stably exerted at an appropriate timing regardless of the dimensional accuracy of the card. Moreover, the card can be stably and certainly ejected at an appropriate speed while preventing the card from spring out of the card connector. Accordingly, it is possible to provide a card connector which can be easily produced in a simple structure at a low cost with high reliability thereof without increasing the number of components.

BRIEF DESCRIPTION OF THE FIGURES

The organization and manner of the structure and operation of the Present Application, together with further objects and advantages thereof, may best be understood by reference to the following Detailed Description, taken in connection with the accompanying Figures, wherein like reference numerals identify like elements, and in which:

FIGS. 4A and 4B are views illustrating a memory card according to the Present Application, in which FIG. 4A is a bottom plan view and FIG. 4B is a top plan view;

DESCRIPTION OF THE PREFERRED EMBODIMENTS

Figure 1:
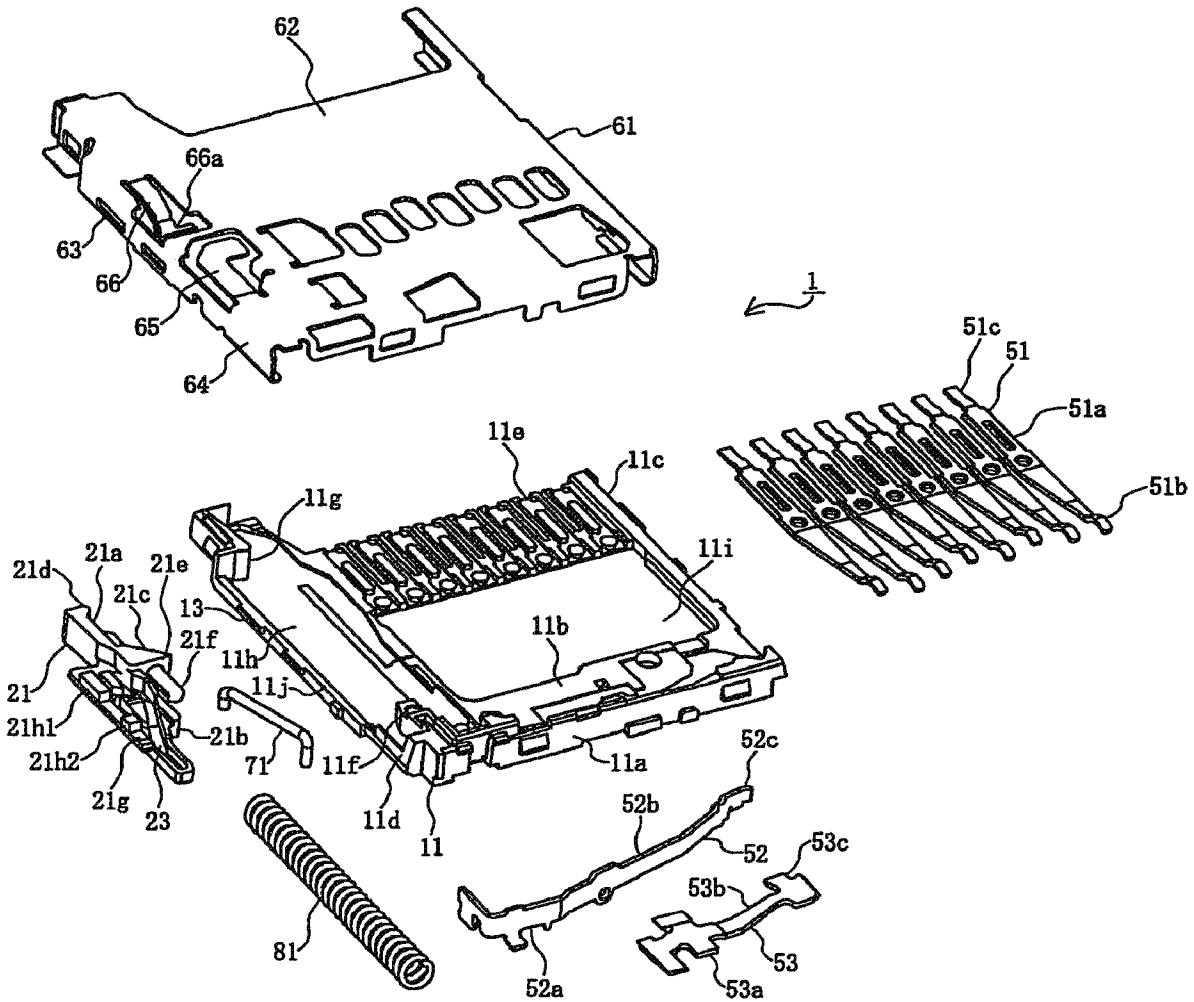
FIG. 1 is an exploded perspective view of a card connector according to the Present Application.

While the Present Application may be susceptible to embodiment in different forms, there is shown in the Figures, and will be described herein in detail, specific embodiments, with the understanding that the disclosure is to be considered an exemplification of the principles of the Present Application, and is not intended to limit the Present Application to that as illustrated.

In the illustrated embodiments, directional representations—i.e., up, down, left, right, front, rear and the like, used for explaining the structure and movement of the various elements of the Present Application, are relative. These representations are appropriate when the elements are in the position shown in the Figures. If the description of the position of the elements changes, however, it is assumed that these representations are to be changed accordingly.

In the drawing figures, a card connector according to an embodiment of the present invention, generally designated by reference numeral 1, is attached to an electronic device or apparatus (not illustrated). A card 101 (described later) is inserted in the card connector 1, and the card 101 is mounted on the electronic device or apparatus through intervention of the card connector 1. Examples of the electronic device or apparatus include a personal computer, a cellular phone, a PDA, a digital camera, a video camera, a music player, a game machine, a car navigation device, and the like; however, the type of devices and apparatuses may be any type without being particularly limited to the above-mentioned devices and apparatuses. Further, the card 101 is an IC card such as a SIM card, a MMC (registered trademark), a SD (registered trademark) card, a mini SD (registered trademark) card, an xD picture card (registered trademark), a Memory Stick (registered trademark), a Memory Stick Duo (registered trademark), Smart Media (registered trademark), a T-Flash (Trans-Flash) memory card, or a micro SD (registered trademark) card. Although the type of cards is not particularly limited to the above-mentioned ones, in the present embodiment, the card 101 will be described as being a micro SD (registered trademark) card.

Here, the card connector 1 is provided with a housing 11 that is integrally formed of an insulating material such as synthetic resin and a shell 61 as a cover member that is integrally formed by punching and bending a plate member formed of a conductive material such as metallic member so as to be mounted on the top of the housing 11. The shell 61 is configured to cover at least a portion of an upper portion of the housing 11 and the card 101 that is accommodated in the housing 11. Moreover, the card connector 1 has a generally flat rectangular parallelepiped shape, which is attached to the electronic device or apparatus, and in which the card 101 is inserted from a front side thereof (the left upper side in the drawing figures).

Figure 3:
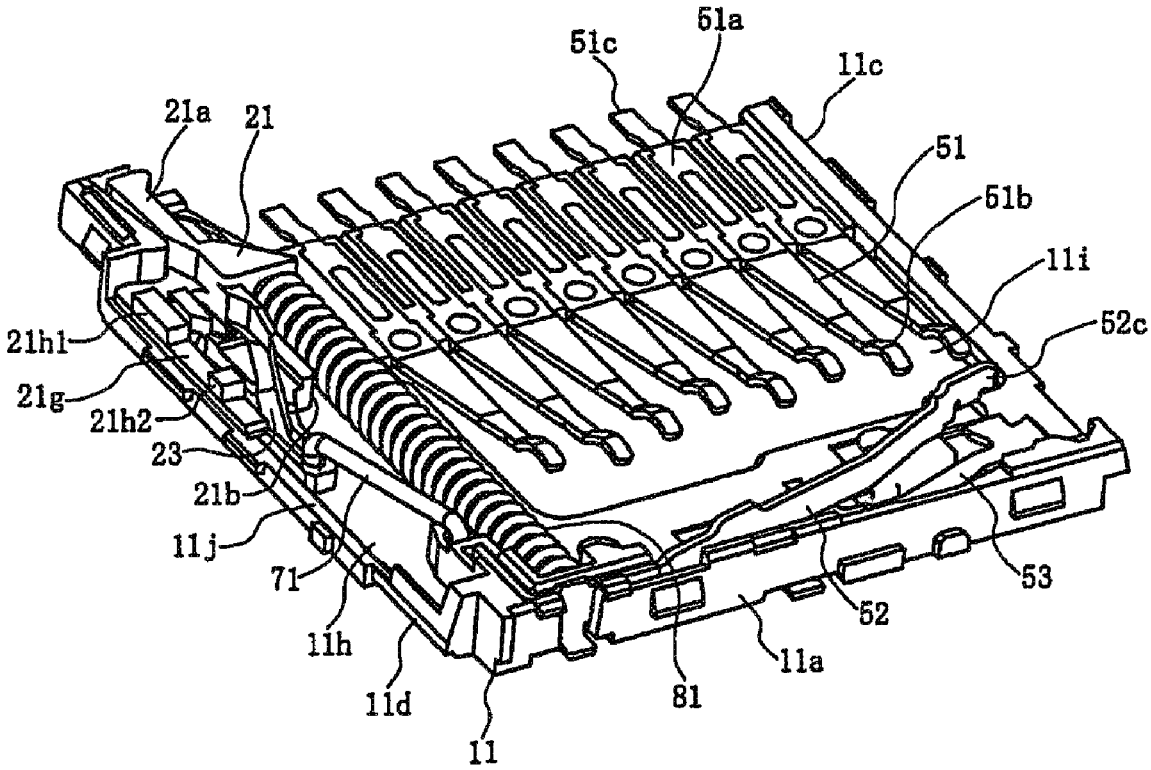
FIG. 3 is a perspective view of the card connector of FIG. 1, illustrating a state where a shell of the card connector is removed.

As illustrated in the drawing figures, the housing 11 is provided with a bottom wall portion 11*b* having such a shape that a front end portion thereof (the left upper side in FIG. 3) serving as a front side in relation to an insertion direction of the card 101 is excised into an approximately U or inverted-C shape and an innermost wall portion 11*a* that stands upward from the bottom wall portion 11*b* so as to extend along an edge at the innermost side (the right lower side in FIG. 3) of an innermost portion of the bottom wall portion 11*b*. Here, the bottom wall portion 11*b* is provided, in an upper surface thereof, with a terminal holding portion 11*e* to which a plurality of terminals 51 as an assembly of connection terminals is attached. On the upper surface of the terminal holding portion 11*e*, a plurality of terminal fitting grooves is formed so as to extend in a front-rear direction (a direction for connecting the left upper side and the right lower side in FIG. 3), and the terminals 51 as the connection terminals are inserted and fitted into the respective terminal fitting grooves.

The terminals 51 have base portions thereof 51*a* being fitted into corresponding ones of the terminal fitting grooves and have extreme end portions thereof 51*b* extending obliquely upward toward the innermost wall portion 11*a* so as to be projected further outward from the upper surface of the bottom wall portion 11*b*. The extreme end portions 51*b* of the terminals 51 function as a contact portion, respectively, and are brought into electrical contact with a plurality of contact pads 151 formed as terminal members that are arranged on a lower surface of the card 101. Moreover, solder tail portions 51*c* that extend from the base portions of the terminals 51 are projected toward the front side from the front edge of the bottom wall portion 11*b* and electrically connected to signal lines, contact pads, and terminals, and the like, formed on a wiring board of the electronic device or apparatus, that is, to counterpart terminal members, by means of soldering.

Moreover, in a portion of the bottom wall portion 11*b* corresponding to a lower side of the extreme end portions 51*b* of the terminals 51, an opening portion 11*i* is formed, which penetrates through the bottom wall portion 11*b* in a thickness direction. It should be noted that the opening portion 11*i* may be canceled as required.

Further, the housing 11 includes a first side wall portion 11*c* as a side wall having an L-shaped cross section and extending in the front-rear direction along one lateral edge of the bottom wall portion 11*b* and a second side wall portion 11*d* as a side wall extending in the front-rear direction along the other lateral edge of the bottom wall portion 11*b*.

A card guide mechanism accommodation portion 11*h* is formed on an inner side of the second side wall portion 11*d*, and a slide member 21 of a card guide mechanism for guiding the card 101 inserted into the card connector 1 is fitted to the card guide mechanism accommodation portion 11*h* so as to be slidable in the front-rear direction. Here, the slide member 21 is configured by a card holding portion 21*a* for holding the card 101, a slide cam portion 21*b* as a movable cam member, and a brake-receipt portion 21*g* configured to receive a braking force for controlling the sliding speed. The card holding portion 21*a*, the slide cam portion 21*b*, and the brake-receipt portion 21*g* are formed by integral molding with an insulating material such as synthetic resin.

Furthermore, the card holding portion 21*a* is provided with a first engagement portion 21*c* and a second engagement portion 21*d* that are projected from side surfaces at an inner side thereof. The first engagement portion 21*c* and the second engagement portion 21*d* engage with an engagement portion containing an unevenness that is formed on the side surface of the card 101. Moreover, the slide member 21 moves in the front-rear direction together with the card 101 in a state where the card 101 is held by the first engagement portion 21*c* and the second engagement portion 21*d* of the card holding portion 21*a*.

In addition, a side surface at the innermost side of the card holding portion 21*a* functions as an urging force receiving portion 21*e* that receives an urging force of an urging member 81 configured as a coil spring capable of exerting an urging force in a compressed state. A locking projection 21*f* that locks the urging member 81 is formed in the urging force receiving portion 21*e*, and one end of the urging member 81 is attached to the locking projection 21*f*. Further, the other end of the urging member 81 is attached to the innermost wall portion 11*a*. Moreover, the innermost wall portion 11*a* is formed with a locking projection configured to be capable of locking the urging member 81. Owing to such a configuration, the slide member 21 is urged in a direction opposite to the insertion direction of the card 101, that is, in an ejection direction of the card 101, by the urging member 81.

The card connector 1 is a so-called push-in/push-out type connector, or commonly known as, a push-push type connector that requires an operation of pushing the card 101 both when the card 101 is inserted into the card connector 1 and when the card 101 is ejected out of the card connector 1. Such an operation is the same as an alternate action (a position retention type or a push-on/push-off type) in the field of a push button switch. The slide cam portion 21*b* functions as a slide cam in a cam mechanism of a heart-shaped cam for realizing the push-push type action.

For this reason, a cam groove 23 is formed in an upper surface of the slide cam portion 21*b*, and a free end of an elongated pin member 71 as a fixed cam member is engaged with the cam groove 23. Further, the other end of the pin member 71 is a fixed end and is latched to an upper surface of a latching portion 11*f* formed in a portion of the card guide mechanism accommodation portion 11*h* of the housing 11 that is located in the vicinity of the innermost wall portion 11*a* so as to be pivotably coupled thereto. Moreover, by the cooperation of the pin member 71 and the cam groove 23, the slide member 21 that moves together with the card 101 can perform the push-push operation. Owing to such a configuration, when the card 101 is moved in the insertion direction so as to reach a termination point by a push operation for pushing the card 101 in the insertion direction, the card guide mechanism moves the card 101 in a direction opposite to the insertion direction from the termination point by an urging force of the urging member 81 so that the card 101 is ejected. In this case, the slide member 21 moving in the direction opposite to the insertion direction comes into tight contact with a stopper portion 11*g* formed in the vicinity of the front end of the second side wall portion 11*d* and stops there.

The pin member 71 is held by being urged downward from an upper side by a pin pressing member 65 of the shell 61. The pin pressing member 65 is a plate-like member having restoring properties and formed by bending a portion of the shell 61 so as to be able to apply a pressing force toward the bottom wall portion 11*b* of the housing 11. The pin member 71 is disposed between the pin pressing member 65 and the slide member 21 or the housing 11 so as to be held in a state where it is not separated from the slide member 21 or the housing 11.

Figure 2:
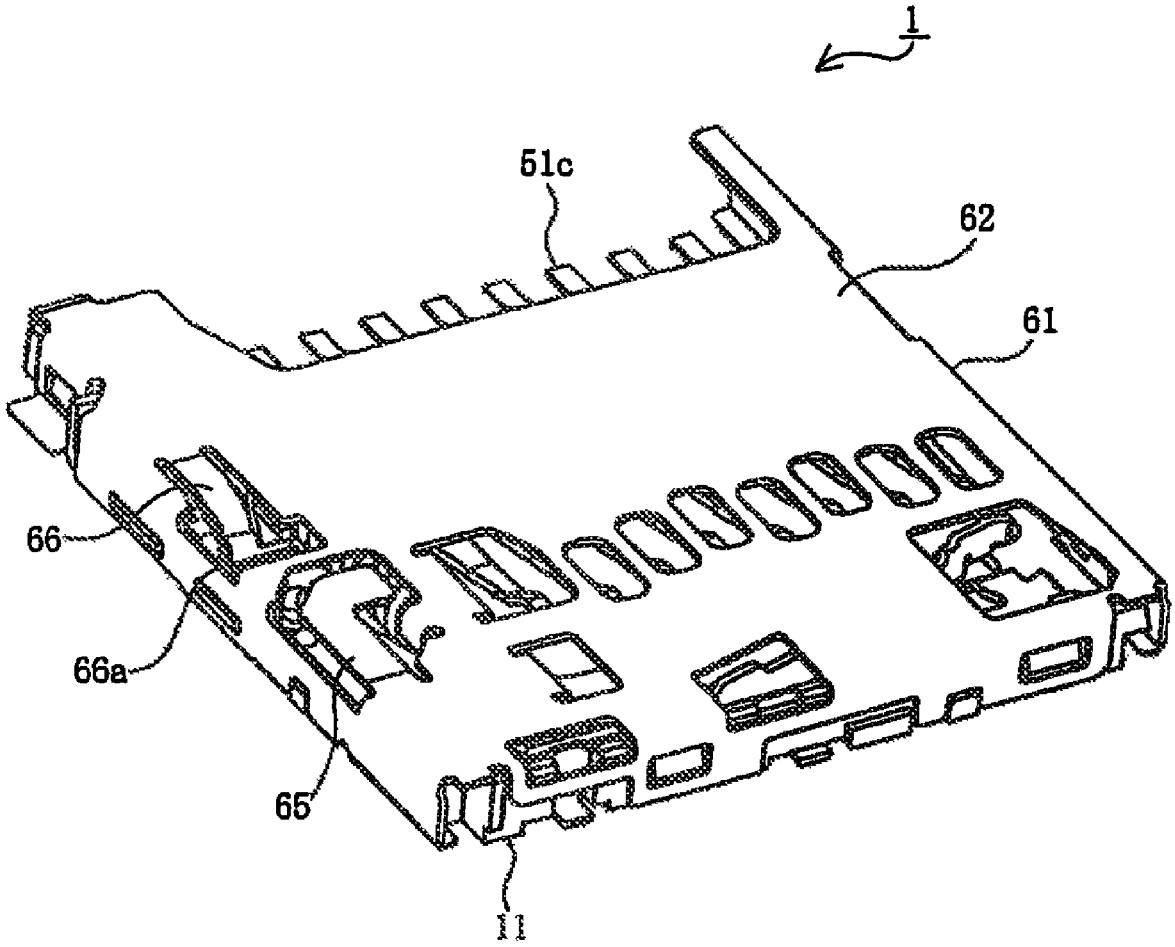
FIG. 2 is a perspective view of the card connector of FIG. 1.

Further, the shell 61 has a generally rectangular top plate portion 62 and a plurality of side plate portions 64 that is erected from a plurality of locations of the lateral edges of the top plate portion 62. Each of the side plate portions 64 is provided with a plurality of latching openings 63. As will be understood from FIG. 2, when the shell 61 is attached to an upper side of the housing 11, the latching openings 63 are latched to latching projections 13 that are formed on outer surfaces of the innermost wall portion 11*a*, the first side wall portion 11*c*, and the second side wall portion 11*d* of the housing 11, and thus, the shell 61 is fixed to the housing 11.

Moreover, the shell 61 includes a brake member 66 formed in the top plate portion 62, as well as the pin pressing member 65. The brake member 66 is a cantilever-like leaf spring member formed by cutting and raising a portion of the top plate portion 62. The brake member 66 has a base end portion thereof being integrally connected to the top plate portion 62 and a free end portion thereof being formed with a convex sliding portion 66*a* configured to downwardly protrude therefrom. Moreover, the brake member 66 is formed in a portion of the top plate portion 62 being located in the vicinity of the side plate portion 64 corresponding to the second side wall portion 11*d*, and is configured to generally extend in the front-rear direction along the side plate portions 64. The sliding portion 66*a* is configured to extend obliquely downward from a base end thereof toward the innermost side, that is, in the direction for approaching the bottom wall portion 11*b*.

The brake-receipt portion 21*g* of the slide member 21 is an elongated rectangular plate-like member arranged on a lateral side of the slide cam portion 21*b* so as to extend along the movement direction of the slide member 21, namely, in the direction from the front to the rear and vice versa. The lower surface of the brake-receipt portion 21*g* slides on a sliding face 11*j* which is an upper surface of the second side wall portion 11*d* of the housing 11. More specifically, the brake-receipt portion 21*g* is always upwardly supported by the sliding face 11*j* from below.

A top surface of the brake-receipt portion 21*g*, which is an upper surface thereof, is configured to function as a braking face capable of permitting the sliding portion 66*a* of the brake member 66 to be in close contact therewith and receiving a braking force when the sliding portion 66*a* makes slide contact therewith during sliding of the slide member 21. Moreover, a first convex portion 21*h*1 that is positioned close to the frontmost side in relation to the insertion direction of the card 101 and a second convex portion 21*h*2 that is positioned close to the innermost side in relation to the insertion direction of the card 101 are respectively formed as a raised portion provided on a top surface of the brake-receipt portion 21*g*. Each of the first and second convex portions 21*h*1 and 21*h*2 is rectangular in side view thereof, and a top surface thereof is parallel with the top surface of the brake-receipt portion 21*g* and is similarly capable of functioning as a braking face. The first and second convex portions 21*h*1 and 21*h*2 are formed in an intermediate range in the longitudinal direction, i.e., the front-rear direction, of the top surface of the brake-receipt portion 21*g*. Moreover, the first and second convex portions 21*h*1 and 21*h*2 are spaced apart from each other by a predetermined distance in the insertion direction of the card 101. Therefore, a height of the braking face of the brake-receipt portion 21*g* changes in the order of low, high, low, high, and low, in the direction from the front side toward the innermost side. The top surface of each of the first and second convex portions 21*h*1 and 21*h*2 is not necessarily flat but may be formed with a concave portion; however, in this specification, the case of the flat top surface will be described, for the convenience sake of explanation.

The brake member 66 is formed at a position where the sliding portion 66*a* confronts the top surface of the brake-receipt portion 21*g* in a state where the shell 61 is fixed to the housing 11. When the sliding portion 66*a* is pressed against the top surface of the brake-receipt portion 21*g* by the restoring force of the brake member 66, a braking force for applying a brake to the slide member 21 moving in the front-rear direction is generated. Since the brake member 66 is a member formed by applying processing, e.g., punching and bending, to the top plate portion 62 of the shell 61 formed of a metal plate, it can be easily produced with high accuracy. Moreover, since the brake member 66 is made of metal, it is able to exhibit extremely stable restoring properties. Therefore, the brake member 66 is able to stably generate a braking force of a desired magnitude in a state where the sliding portion 66*a* is in close contact with the top surface of the brake-receipt portion 21*g*. Among other things, it should be noted that the sliding portion 66*a* is not always necessary to make close contact with the top surface of the brake-receipt portion 21*g* to generate the braking force, but depending on the position of the slide member 21 moving in the front-rear direction, may be in a state of being in no contact with the top surface of the brake-receipt portion 21*g* and generating no braking force.

The housing 11 is formed, in the innermost portion thereof, with a card detection switch capable of detecting that the contact pads 151 of the card 101 are in contact with the terminals 51 and thus detecting that the card 101 is fitted into the card connector 1. The card detection switch is comprised of a first contact member 52 and a second contact member 53 which are attached to the innermost wall portion 11*a* and to a position in the vicinity thereof. Although the switch may be any type of switch such as a switch capable of detecting a connection state between the contact pads 151 of the card 101 and the terminals 51, the case of the card detection switch will be described, for the convenience sake of explanation.

The first contact member 52 includes an attachment portion 52*a* that is attached to the innermost wall portion 11*a*, a cantilever-like body portion 52*b* that is connected to the attachment portion 52*a* at a base end thereof and extends laterally, i.e., toward the first side wall portion 11*c*, and an abutting portion 52*c* that is connected to a free end of the body portion 52*b*. Specifically, the attachment portion 52*a* is substantially parallel to the side surface of the innermost wall portion 11*a*. The body portion 52*b* is angled with respect to the side surface of the innermost wall portion 11*a* in a state where the card 101 is not yet fitted by insertion into the card connector 1. The abutting portion 52*c* is arranged to protrude toward the front side with respect to the insertion direction of the card 101. Therefore, when the card 101 is inserted, the front end of the card 101 comes into close contact with the abutting portion 52*c*.

On the other hand, the second contact member 53 includes an attachment portion 53*a* that is attached to a portion of the bottom wall portion 11*b* which is located in the vicinity of the innermost wall portion 11*a*, a cantilever-like body portion 53*b* that is connected to the attachment portion 53*a* at a base end thereof and extends toward the first side wall portion 11*c*, and an abutting portion 53*c* that is connected to a free end of the body portion 53*b*. Further, the second contact member 53 is disposed on a lower side than the first contact member 52 and in the vicinity of the innermost wall portion 11*a*.

For this reason, in a state where the card 101 is not yet inserted, the first contact member 52 and the second contact member 53 are in no contact with each other, and thus, the card detection switch is in a non-conduction state, that is, in an OFF state.

When the card 101 is inserted to reach a position where the contact pads 151 and the terminals 51 are in contact with each other, the abutting portion 52*c* of the first contact member 52 is pressed by the front end of the card 101 to be moved toward the innermost wall portion 11*a*, so that the abutting portion 52*c* is brought into tight contact with the abutting portion 53*c* of the second contact member 53. With this operation, the first contact member 52 and the second contact member 53 are brought into close contact with each other, and thus, the card detection switch is put in a conduction state, namely, in an ON state.

Figure 4B:
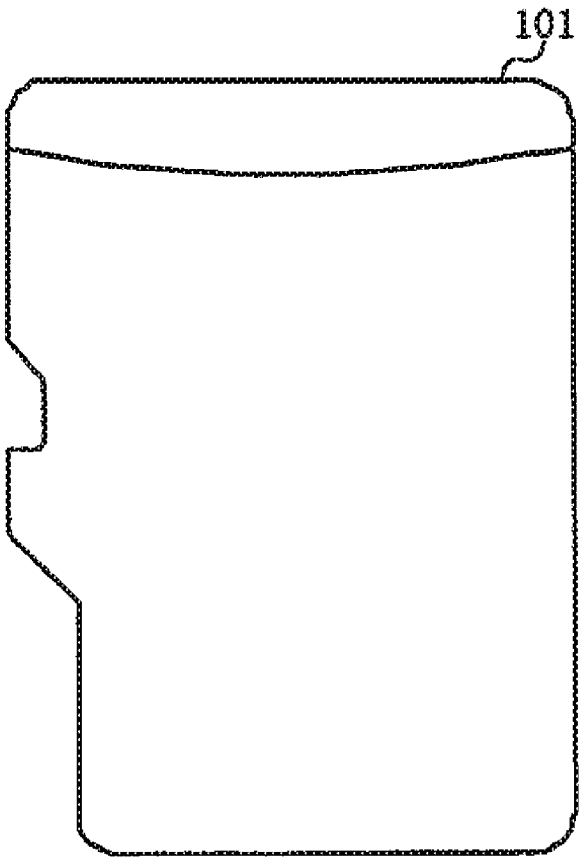
Figure 4A:
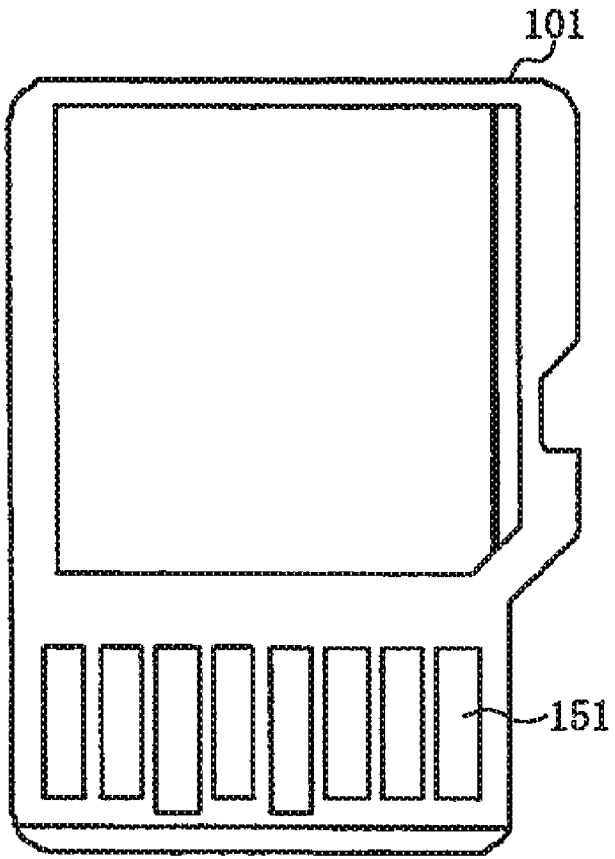

Next, a description of the structure of the card 101 will now be provided herein below. As described above, in the present embodiment, the card 101 is a micro SD (registered trademark) card and has a generally rectangular plate-like shape as illustrated in FIGS. 4A and 4B, having a dimension that a length (the vertical dimension in FIGS. 4A and 4B) is 15.0 mm and a width (the horizontal dimension in FIGS. 4A and 4B) is 11.0 mm. A plurality of contact pads 151 is arranged at a position in the vicinity of the front end of a principal surface thereof so as to extend along one edge thereof.

Next, a description of the operation of the card connector 1 having the above-described structure will be provided below. First, the operation when the card 101 is inserted will be described. In this case, a user inserts the card 101 from the front side of the card connector 1 by the user's fingers or the like. The card 101 is inserted in an attitude wherein the front end thereof is directed toward the innermost wall portion 11*a* of the housing 11, the lower surface thereof having the contact pads 151 arranged thereon opposes the bottom wall portion 11*b*, and the upper surface thereof without the contact pads 151 arranged thereon opposes the top plate portion 62 of the shell 61. With this operation, the card 101 is inserted into the housing 11 with the one side surface thereof being guided along the first side wall portion 11*c* of the housing 11 while the other side surface thereof as the engagement portion having formed thereon a convex portion, a concave portion, and a flat surface portion, being guided along the second side wall portion 11*d* of the housing 11.

Subsequently, when the user pushes the card 101 further toward the deeper side of the housing 11, the first engagement portion 21*c* and the second engagement portion 21*d* of the slide member 21 are respectively engaged with the engagement portions on the side surfaces of the card 101, so that the card 101 is moved toward the innermost wall portion 11*a* together with the slide member 21 while being securely held by the slide member 21. At this time, the pressing force exerted by the user's fingers or the like is transmitted from the engagement portions of the card 101 via the first engagement portion 21*c* or the second engagement portion 21*d* to the slide member 21. Then, since the slide member 21 pressurizes the urging member 81 comprised of a coil spring, the slide member 21 and the card 101 receive a repulsive force of the urging member 81. However, since the repulsive force is weaker than the pressing force of the user's fingers or the like, the slide member 21 and the card 101 are forced to move while resisting against the repulsive force. In this case, the slide member 21 slides along the second side wall portion 11*d*, and the card 101 is moved together with the slide member 21. Then, the slide member 21 and the card 101 reach an over-stroke position where they advance further forward than the lock position, thereby entering into an over-stroke state.

Subsequently, when the user stops the operation of pushing the card 101 to release the application of the pressing force to the card 101, the slide member 21 and the card 101 are moved in a direction away from the innermost wall portion 11*a* by the repulsive force of the urging member 81. Then, the slide member 21 and the card 101 stop at the lock position whereat the card 101 is held at a locked state within the card connector 1. This is because the free end of the pin member 71 being engaged with the cam groove 23 formed on the upper surface of the slide cam portion 21*b* of the slide member 21 is latched to a portion of the cam groove 23 to stop the movement of the slide member 21, so that the slide member 21 ceases its movement at the lock position.

Moreover, since the card 101 is held at the lock position, the card 101 enters into a state where data can be transmitted and received between the card 101 and calculation means or the like of the electronic device or apparatus equipped with a board having the card connector 1 mounted thereon. Furthermore, when the card 101 is held at the lock position, the contact pads 151 of the card 101 are brought into contact with and electrically connected to the extreme end portions 51*b* of the terminals 51. In addition, the abutting portion 52*c* of the first contact member 52 of the card detection switch is pressed by the front end of the card 101 to be displaced toward the innermost side, so that the abutting portion 52*c* is brought into close contact with the abutting portion 53*c* of the second contact member 53. With this operation, the first contact member 52 and the second contact member 53 are brought into contact with each other, and thus, the card detection switch is in an ON state.

Figure 5:
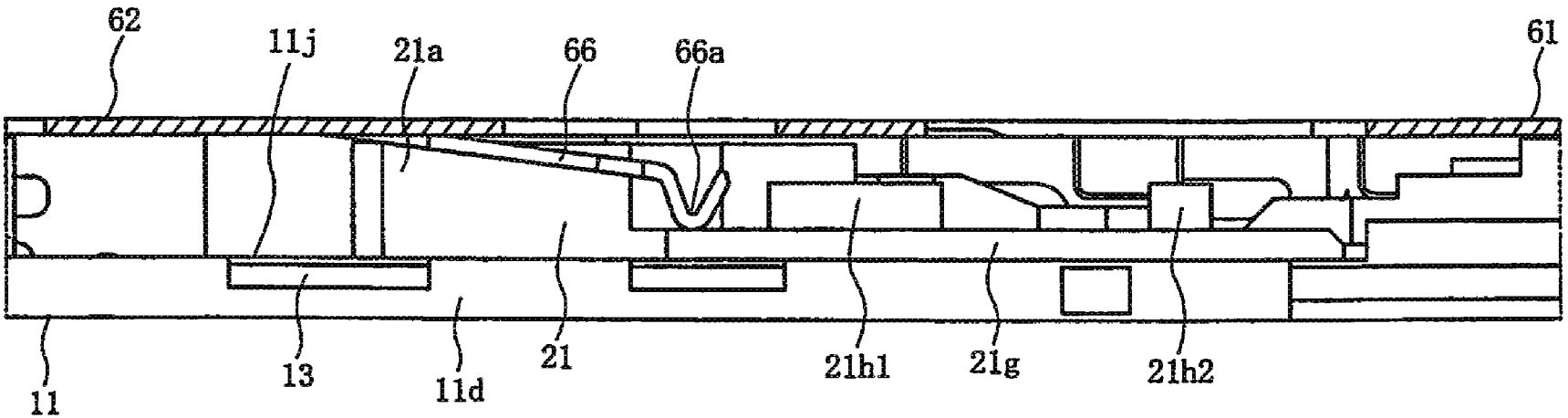
FIG. 5 is a side view of the card connector of FIG. 1, illustrating the state where a side plate portion of the shell is removed when a slide member of the card connector reaches an over-stroke position thereof.

Next, a description of the operation of ejecting the card 101 from the card connector 1 will now be provided herein below. In this case, when the user pushes the card 101 by the user's fingers or the like, the slide member 21 and the card 101 are moved toward the innermost wall portion 11*a* from the lock position. Moreover, when the user pushes the card 101 further toward the deeper side of the housing 11, the slide member 21 and the card 101 reach the over-stroke position where they further advance forward than the lock position, thereby entering into an over-stroke state, as best shown in FIG. 5.

When the slide member 21 is at the over-stroke position, the sliding portion 66*a* of the brake member 66 is in close contact with the top surface of the brake-receipt portion 21*g*. That is to say, the sliding portion 66*a* comes into close contact with the low portion of the braking face. Therefore, the slide member 21 receives a weak braking force when it is positioned in the range of the over-stroke position and the vicinity thereof. Nevertheless, when the slide member 21 is at the over-stroke position but the sliding portion 66*a* is not yet in close contact with the top surface of the brake-receipt portion 21*g*, the slide member 21 does not receive any braking force as long as it is positioned in the range of the over-stroke position and the vicinity thereof.

Subsequently, when the user stops the operation for pushing the card 101 to release the application of the pressing force to the card 101, the slide member 21 and the card 101 being positioned at the over-stroke position are moved in a direction away from the innermost wall portion 11*a*, namely, in a direction opposite to the insertion direction, by the urging force of the urging member 81. In this case, as described above, since the slide member 21 receives only a weak braking force from the brake member 66 or any braking force is not generated, the urging force of the urging member 81 might not be substantially diminished by the braking force of the brake member 66.

At a time point when the slide member 21 and the card 101 start moving in the direction opposite to the insertion direction from the over-stroke position, namely, at a time point when the operation of ejecting the card 101 is started, static friction is stronger than dynamic friction during periods where they start moving from a stationary state. Therefore, a force stronger than the static friction needs to be applied to the slide member 21 and the card 101 as the ejecting force.

For this reason, if the braking force of the brake member 66 is too strong at the time point when the operation for ejecting the card 101 is started, the urging force of the urging member 81 is greatly diminished, and thus, a sufficiently large ejecting force cannot be applied to the slide member 21 and the card 101. As a result, the operation for ejecting the card 101 cannot be started. That is to say, the ejection properties of the card 101 are deteriorated, and in the worst case, the card 101 may not be ejected.

However, in the present embodiment, as described above, at the time point when the operation for ejecting the card 101 is started, since the slide member 21 receives only a weak braking force from the brake member 66, the urging force of the urging member 81 is not greatly diminished, and thus, a sufficiently large ejecting force can be applied to the slide member 21 and the card 101. Owing to such a configuration, even when the top surface of the card 101 makes frictional contact with the inner surface of the housing 11 and/or the shell 61 and thus a strong frictional force is applied to the card 101, since the ejecting force applied to the slide member 21 and the card 101 is stronger than the frictional force, the card 101 can be moved in the direction opposite to the insertion direction to be securely ejected. That is to say, the ejection properties of the card 101 are not deteriorated.

Figure 6:
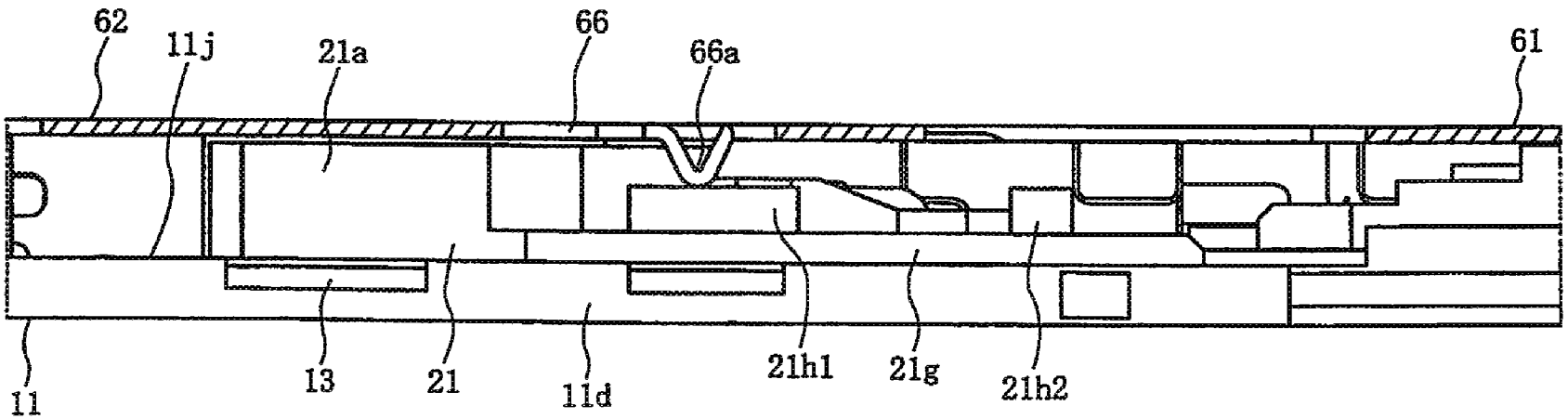
FIG. 6 is a side view of the card connector of FIG. 1, illustrating the state where the side plate portion of the shell is removed when the slide member of the card connector reaches a lock position thereof.

When the operation for ejecting the card 101 is started, the slide member 21 and the card 101 are moved toward the front side by the urging force of the urging member 81 to pass through the lock position as illustrated in FIG. 6 to be moved further in the direction opposite to the insertion direction of the card 101.

When the slide member 21 is positioned at the lock position or the vicinity thereof, the sliding portion 66*a* of the brake member 66 is in close contact with the top surface of the first convex portion 21*h*1. That is to say, the sliding portion 66*a* comes into close contact with the high portion of the braking face. Therefore, the slide member 21 receives a strong braking force when it is positioned in a predetermined range of the lock position and the vicinity thereof, namely, a range where the first convex portion 21*h*1 is present. Moreover, since the urging force of the urging member 81 is greatly diminished by the braking force of the brake member 66, the moving speed of the slide member 21 and the card 101 is effectively decelerated. Owing to such a configuration, it is possible to prevent the card 101 from springing out of the card connector 1.

As described above, the first and second convex portions 21*h*1 and 21*h*2 are formed in the intermediate range in the front-rear direction of the top surface of the brake-receipt portion 21*g*, and the height of the braking face of the brake-receipt portion 21*g* changes in the order of low, high, low, high, and low, in a direction from the front side toward the innermost side. Moreover, the position of the first convex portion 21*h*1 that is positioned on the frontmost side is slightly separated from the sliding portion 66*a* of the brake member 66 at the time instant when the slide member 21 is positioned at the over-stroke position, as illustrated in FIG. 5. Therefore, during a short period after the operation for ejecting the card 101 is started, the sliding portion 66*a* comes into close contact with the top surface of the brake-receipt portion 21*g* but does make no contact with the top surface of the first convex portion 21*h*1. That is to say, the sliding portion 66*a* comes into contact with the low portion of the braking face but does make no contact with the high portion. Therefore, the slide member 21 does not receive any strong braking force until a moving speed thereof is accelerated to some degree by the urging force of the urging member 81. As illustrated in FIG. 6, at the time instant when the sliding portion 66*a* comes into close contact with the top surface of the first convex portion 21*h*1, since the slide member 21 and the card 101 are already moved, the frictional force that they receive changes to the dynamic friction that is weaker than the static friction. Further, since the inertial force is generated, they might not stop even when a strong braking force is applied thereto. That is to say, the ejection properties of the card 101 are not deteriorated.

However, when the portion of the braking face coming into contact with the sliding portion 66*a* changes from the top surface of the brake-receipt portion 21*g* to the top surface of the first convex portion 21*h*1, namely, when the sliding portion 66*a* comes into close contact with the front end (the left end in FIGS. 5 and 6) of the first convex portion 21*h*1, the braking force increases in a stepwise manner, and therefore, the slide member 21 is expected to receive an extremely strong braking force. However, as described above, at this time instant, in addition to the fact that the friction changes to the smaller dynamic friction and the inertial force is generated, since the urging member 81 comprised of the coil spring is in a greatly compressed state, a large urging force is generated. For this reason, even when the slide member 21 receives an extremely strong braking force from the sliding portion 66*a*, the slide member 21 and the card 101 won't cease their movement. In addition, the braking force when the sliding portion 66*a* comes into close contact with the front end of the first convex portion 21*h*1 may be decreased by appropriately modifying the shape of the sliding portion 66*a* and/or the front end of the first convex portion 21*h*1; for example, the front end of the first convex portion 21*h*1 may be configured to have a curved or sloped surface, and the slope of the outer shape of the sliding portion 66*a* may be made gentle or the curvature of the outer shape may be increased.

Figure 7:
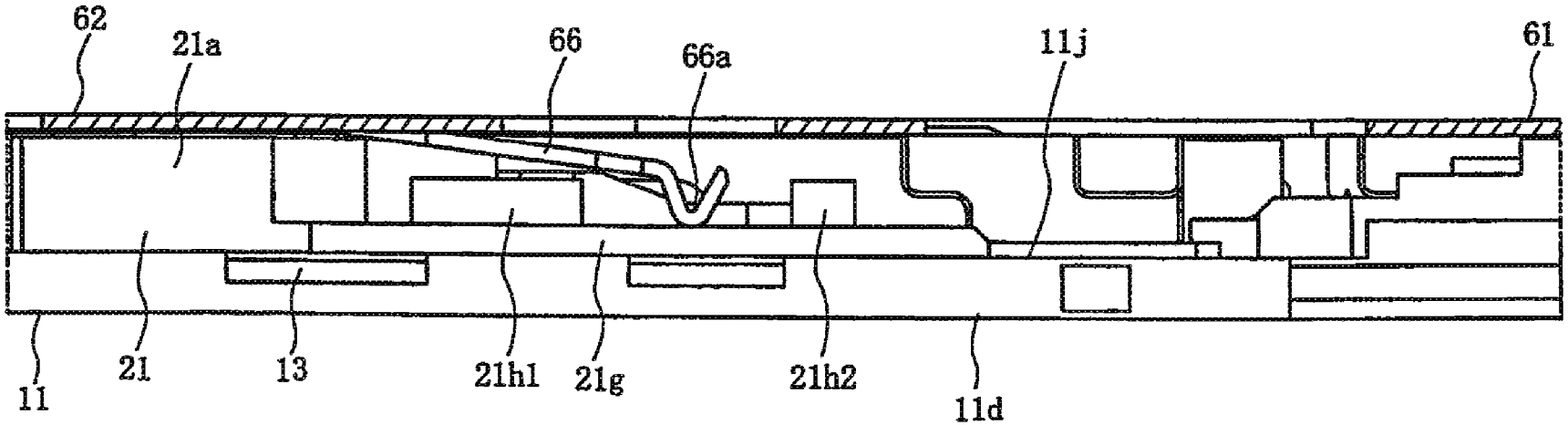
FIG. 7 is a side view of the card connector of FIG. 1, illustrating the state where a side plate portion of the shell is removed when a slide member of the card connector reaches a terminal-ejection position thereof.

After the slide member 21 and the card 101 are further moved toward the front side by the urging force of the urging member 81 to pass through the lock position, they are moved in the direction opposite to the insertion direction of the card 101 while passing through a terminal-ejection position as illustrated in FIG. 7. When the card 101 reaches the terminal-ejection position, the contact between the contact pads 151 of the card 101 and the extreme end portions 51*b* of the terminals 51, which has been maintained till then, is disrupted, so that the contact pads 151 and the terminals 51 are put into a non-conduction state. Moreover, the abutting portion 52*c* of the first contact member 52 of the card detection switch moves back to its original position by the restoring properties of the body portion 52*b*. For this reason, the first contact member 52 and the second contact member 53 are in no contact with each other, and thus, the card detection switch is in an OFF state.

When the slide member 21 is positioned at the terminal-ejection position or the vicinity thereof, the sliding portion 66*a* of the brake member 66 is in close contact with the top surface of the brake-receipt portion 21*g*, which is located between the first convex portion 21*h*1 and the second convex portion 21*h*2. That is to say, the sliding portion 66*a* comes into close contact with the low portion of the braking face. Therefore, the slide member 21 receives a weak braking force when it is positioned in a predetermined range of the terminal-ejection position and the vicinity thereof, namely, in the range in position between the first convex portion 21*h*1 and the second convex portion 21*h*2.

As described above, the slide member 21 receives a strong braking force when it is positioned at the lock position or the vicinity thereof and the sliding portion 66*a* is in close contact with the top surface of the first convex portion 21*h*1. On the other hand, while this happens, since the contact pads 151 of the card 101 are in contact with the extreme end portions 51*b* of the terminals 51, the card 101 receives a frictional force from the extreme end portions 51*b*. That is to say, the card 101 receives a relatively strong dynamic friction that is weaker than the static friction. Further, since the urging member 81 comprised of the coil spring is slightly expanded so that the degree of compression thereof is lowered, the generated urging force is slightly decreased. Therefore, a difference between the urging force that the card 101 receives from the urging member 81 and the frictional force decreases. As a result, there is a possibility that, when the slide member 21 further receives a strong braking force, the moving speed of the slide member 21 and the card 101 is decelerated too much, thereby deteriorating the ejection properties of the card 101.

However, in the present embodiment, the braking force that the card 101 receives from the brake member 66 is reduced at a position between the first convex portion 21*h*1 and the second convex portion 21*h*2, thereby preventing the deterioration of the ejection properties of the card 101.

Figure 8:
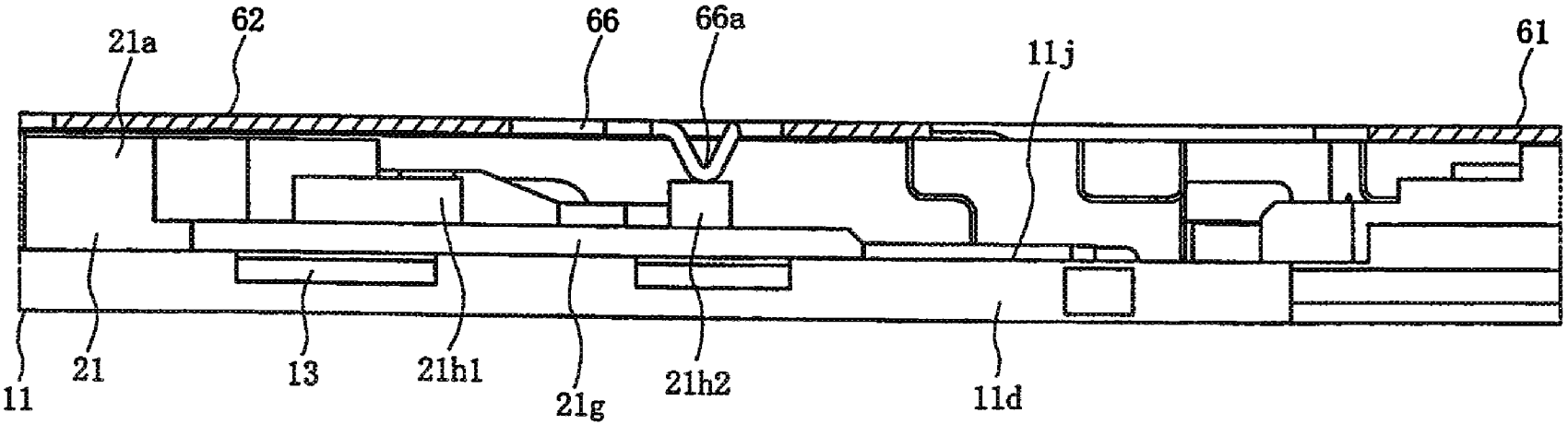
FIG. 8 is a side view of the card connector of FIG. 1, illustrating the state where the side plate portion of the shell is removed when the slide member of the card connector reaches a position located between the terminal-ejection position and a temporary card-holding position thereof.

Subsequently, the slide member 21 and the card 101 are further moved to reach a position located between the terminal-ejection position and the temporary card-holding position as illustrated in FIG. 8. As will be described later, the temporary card-holding position is defined at a position where the slide member 21 ceases its movement.

When the slide member 21 is positioned at the position as illustrated in FIG. 8, the sliding portion 66*a* of the brake member 66 is in close contact with the top surface of the second convex portion 21*h*2. That is to say, the sliding portion 66*a* comes into close contact with the high portion of the braking face. Therefore, the slide member 21 receives a strong braking force when it is positioned in a range where the second convex portion 21*h*2 is present.

After the card 101 passes through the terminal-ejection position, since the contact pads 151 of the card 101 are in no contact with the extreme end portions 51*b* of the terminals 51, the card 101 receives no frictional force from the extreme end portions 51*b*. Therefore, since a difference between the urging force that the card 101 receives from the urging member 81 and the frictional force increases slightly, there is a possibility that the moving speed of the slide member 21 and the card 101 is increased too much.

However, in the present embodiment, the sliding portion 66*a* of the brake member 66 is caused to make close contact with the top surface of the second convex portion 21*h*2 that is arranged closer to the innermost side than the first convex portion 21*h*1, thereby increasing the braking force that the slide member 21 receives from the brake member 66. Owing to such a configuration, the moving speed of the slide member 21 and the card 101 is effectively decelerated, and the card 101 is prevented from springing out of the card connector 1.

However, when the portion of the braking face coming into contact with the sliding portion 66*a* changes from the top surface of the brake-receipt portion 21*g* to the top surface of the second convex portion 21*h*2, namely, when the sliding portion 66*a* comes into close contact with the front end (the left end in FIG. 8) of the second convex portion 21*h*2, the braking force increases in a stepwise manner, and therefore, the slide member 21 is expected to receive an extremely strong braking force. However, as described above, at this time instant, in addition to the fact that the dynamic friction is weak and the inertial force is generated, the urging member 81 comprised of the coil spring is able to generate some degree of urging force. For this reason, even when the slide member 21 receives an extremely strong braking force from the sliding portion 66*a*, the slide member 21 and the card 101 won't cease their movement. In addition, the braking force when the sliding portion 66*a* comes into close contact with the front end of the second convex portion 21*h*2 may be decreased by appropriately modifying the shape of the sliding portion 66*a* and/or the front end of the second convex portion 21*h*2; for example, the front end of the second convex portion 21*h*2 may be configured to have a curved or sloped surface, and the slope of the outer shape of the sliding portion 66*a* may be made gentle or the curvature of the outer shape may be increased.

Figure 9:
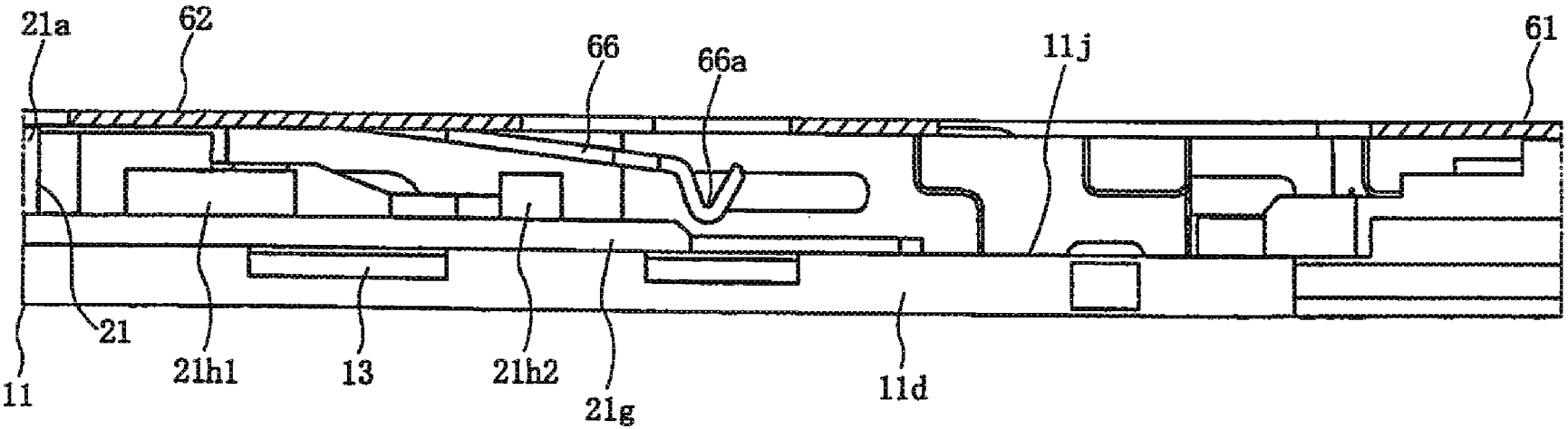
FIG. 9 is a side view of the card connector of FIG. 1, illustrating the state where the side plate portion of the shell is removed when the slide member of the card connector reaches the temporary card-holding position.
Figure 10:
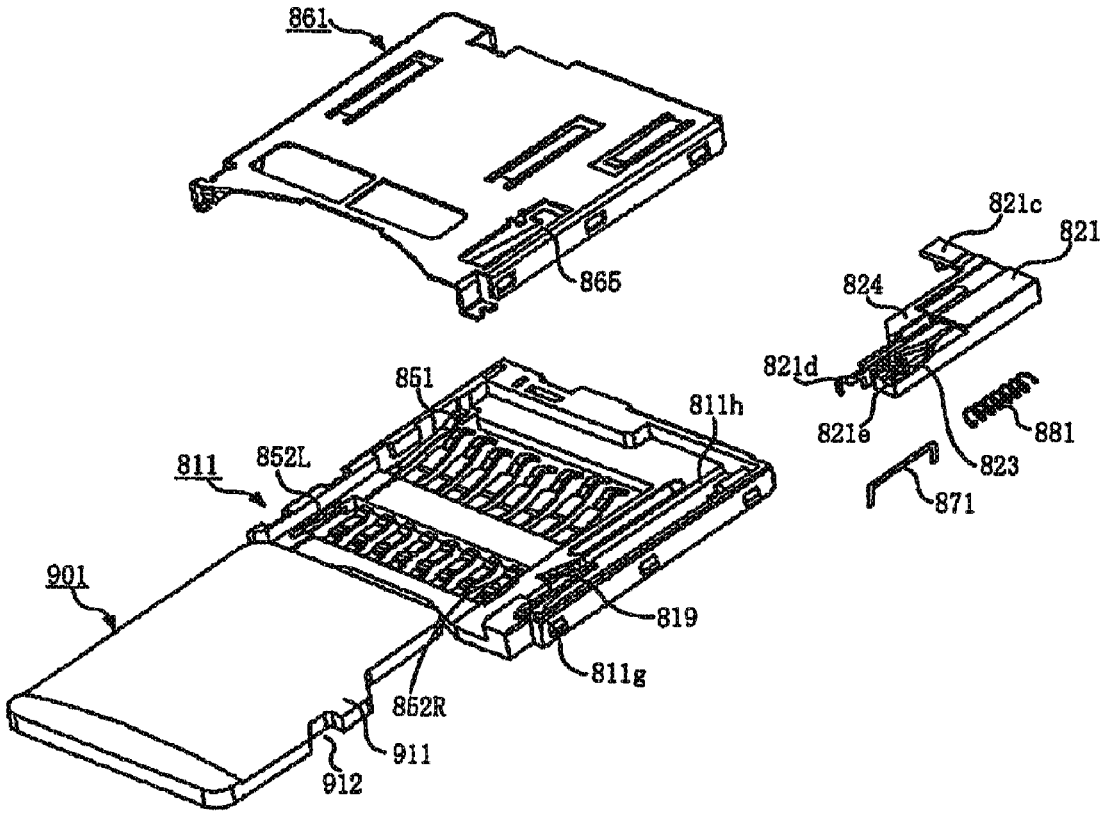
Prior art FIG. 10
FIG. 10 is an exploded perspective view of a card connector according to the prior art.

After the slide member 21 and the card 101 are further moved toward the front side by the urging force of the urging member 81, the slide member 21 comes into close contact with the stopper portion 11*g* formed on the second side wall portion 11*d*, thereby stopping at a temporary card-holding position as illustrated in FIG. 9. At the temporary card-holding position, since the attitude of the slide member 21 changes, the engagement between the first engagement portion 21*c* and the second engagement portion 21*d* of the slide member 21 and the engagement portion of the card 101 becomes moderate. Therefore, although the card 101 is at least held by the slide member 21, when the user pulls out the card 101 with the user's fingers or the like, the state of being held by the slide member 21 is released even without application of a stronger pulling force and thus, the card 101 is taken out of the card connector 1.

When the slide member 21 is positioned at the temporary card-holding position, the sliding portion 66*a* of the brake member 66 is not in close contact with the top surface of the brake-receipt portion 21*g*. That is to say, the innermost end (the right end in FIG. 9) of the brake-receipt portion 21*g* is positioned closer to the front side than the sliding portion 66*a*. In addition, the length of the brake-receipt portion 21*g* may be extended so that even when the slide member 21 is positioned at the temporary card-holding position, the innermost end of the brake-receipt portion 21*g* is positioned closer to the innermost side than the sliding portion 66*a*, and the sliding portion 66*a* comes into close contact with the top surface of the brake-receipt portion 21*g*. That is to say, when the slide member 21 is positioned at the temporary card-holding position, the sliding portion 66*a* is brought into no contact with the braking face or is put into close contact with the low portion of the braking face.

For this reason, the slide member 21 does not receive any braking force, or if receives, a weakened braking force when it is positioned in the range of the temporary card-holding position and the vicinity thereof. Therefore, the urging force of the urging member 81 is never or hardly diminished by the braking force of the brake member 66.

When the slide member 21 is positioned in the range of the temporary card-holding position and the vicinity thereof, the urging member 81 comprised of the coil spring is hardly compressed and has a length close to a free length thereof, and thus, substantially no urging force is generated. Therefore, if the braking force of the brake member 66 is large, there is a possibility that the slide member 21 and the card 101 stop. That is to say, the ejection properties of the card 101 are deteriorated, and in the worst case, there is a possibility that the card 101 is not ejected.

For instance, in the conventional card connector described in "Description of the Related Art" section, the braking force exerted by the brake shoe 819 becomes the maximum when the memory card 901 is ejected from the housing 811, that is, when the slide member 821 reaches the frontmost position and the abutting portion 821*e* comes into tight contact with the stopper portion 811*g*. In such a case, since the coil spring 881 has a length close to a free length thereof and thus the repulsive force thereof becomes the minimum, the braking force exerted by the brake shoe 819 becomes stronger than the repulsive force of the coil spring 881, so that it is highly likely that the memory card 901 is not ejected from the housing 811.

To the contrary, in the present embodiment, since the slide member 21 does not receive a braking force, or if receives, only a weakened braking force when it is positioned in the range of the temporary card-holding position and the vicinity thereof, the urging force of the urging member 81 is never or hardly diminished. Owing to such a configuration, even when the urging force applied from the urging member 81 is small, the slide member 21 and the card 101 are able to reach the temporary card-holding position without stopping midway. That is to say, the ejection properties of the card 101 are not deteriorated.

Furthermore, as described above, at a time instant immediately before the slide member 21 reaches the range of the temporary card-holding position and the vicinity thereof, i.e., is positioned at the lock position or the vicinity thereof, the sliding portion 66*a* of the brake member 66 is in close contact with the upper surface of the first convex portion 21*h*1, i.e., with the high portion of the braking face. Therefore, the moving speed of the slide member 21 and the card 101 is effectively decelerated. For this reason, when the slide member 21 is positioned in the range of the temporary card-holding position and the vicinity thereof, the card 101 is prevented from springing out from the card connector 1 even when no braking force or only a weakened braking force is applied thereto.

Moreover, even when the slide member 21 comes into close contact with the stopper portion 11*g* and stops, since the moving speed thereof is effectively decelerated, no large impact is generated. Furthermore, the present embodiment has been described with respect to a case where the brake member 66 is formed on the top plate portion 62 of the shell 61, the upper surface of the brake-receipt portion 21*g* is configured to function as the braking face, and the first and second convex portions 21*h*1 and 21*h*2 are formed on the upper surface of the brake-receipt portion 21*g*. However, the brake member 66 may be formed on the side plate portions 64 of the shell 61, the side surface of the brake-receipt portion 21*g* may be configured to function as the braking face, and the first and second convex portions 21*h*1 and 21*h*2 may be formed on the side surface of the brake-receipt portion 21*g*.

Moreover, although the present embodiment has been described with respect to a case where two convex portions, namely, first convex portion 21*h*1 and second convex portion 21*h*2, are formed in the brake-receipt portion 21*g*, the number of convex portions may be any number, for example, three or four, as long as it is plural.

In addition, in the present embodiment, a description on the change in the braking force that is applied from the brake member 66 to the brake-receipt portion 21*g* when the card 101 is inserted into the card connector 1 is omitted. This is because the force of inserting the card 101 by the user's fingers or the like is sufficiently larger than the braking force or the urging force of the urging member 81; the card 101 can be inserted into the card connector 1 without being substantially affected by the braking force. Therefore, even when the braking force is applied from the brake member 66 to the brake-receipt portion 21*g*, the operability for inserting the card 101 into the card connector 1 is not deteriorated.

As described above, in the card connector 1 according to the present embodiment, the shell 61 is provided with the cantilever-like brake member 66 which has the base end portion thereof being integrally connected to the shell 61 and the free end thereof being formed with the sliding portion 66*a*. The slide member 21 is provided with the brake-receipt portion 21*g* containing the braking face capable of permitting the sliding portion 66*a* to make close contact therewith, and the braking face is formed therein with the first and second convex portions 21*h*1 and 21*h*2 raised therefrom. Owing to such a configuration, an appropriate magnitude of braking force can be stably exerted at an appropriate timing regardless of the outline finishing accuracy of the card 101. Therefore, the card 101 can be constantly and certainly ejected at an appropriate speed. Moreover, it is possible to prevent the card 101 from springing out of the card connector 1. Furthermore, the card connector 101 can be produced in a simple structure without increasing the number of components. Therefore, the card connector 101 can be easily produced at a low cost with high reliability thereof.

Moreover, the sliding portion 66*a* comes into close contact with a portion of the braking face being located closer to the front side in the insertion direction of the card 101 than the first convex portion 21*h*1 when the card 101 is positioned at the over-stroke position, and comes into close contact with the top surface of the first convex portion 21*h*1 when the card 101 is positioned at the lock position. Owing to such a configuration, at the time instant when the operation for ejecting the card 101 is started, since the slide member 21 receives only a somewhat weakened braking force, the ejection properties of the card 101 are not deteriorated. Moreover, when the slide member 21 is positioned at the lock position, since the urging force of the urging member 81 is greatly diminished by the braking force, the moving speed of the slide member 21 and the card 101 is effectively decelerated and thus, the card 101 is prevented from springing out of the card connector 1.

Furthermore, when the card 101 is ejected, the slide member 21 comes into close contact with the stopper portion 11*g* of the housing 11 and stops. When the slide member 21 comes into close contact with the stopper portion 11*g* and stops, the sliding portion 66*a* comes into close contact with a portion of the braking face being located closer to the innermost side in the insertion direction of the card 101 than the second convex portion 21*h*2 or comes to be positioned closer to the innermost side in the insertion direction of the card 101 than the brake-receipt portion 21*g* so as not to make close contact with the braking face. Owing to such a configuration, when the slide member 21 comes into close contact with the stopper portion 11*g* and stops, the slide member 21 does not receive any braking force, or if receives, a weakened braking force. Therefore, the urging force of the urging member 81 is never or hardly diminished by the braking force. Accordingly, the ejection properties of the card 101 are not deteriorated.

Furthermore, when the card 101 is ejected, so that the card 101 is positioned at a position where the connection between the contact pads 151 and the terminals 51 is disrupted, the sliding portion 66*a* comes into close contact with a portion of the braking face which is located between the first convex portion 21*h*1 and the second convex portion 21*h*2, and which is not provided with the first and second convex portions 21*h*1 and 21*h*2. Owing to such a configuration, since it is possible to reduce the braking force when the contact pads 151 of the card 101 make contact with the terminals 51 and a frictional force is applied to the card 101, the ejection properties of the card 101 are not deteriorated.

Furthermore, when the card 101 is ejected, so that the card 101 is positioned between a position where the connection between the contact pads 151 and the terminals 51 is disrupted and a position where the slide member 21 comes into tight contact with the stopper portion 11*g* of the housing 11 and stops, the sliding portion 66*a* comes into close contact with the top surface of the second convex portion 21*h*2. Owing to such a configuration, since it is possible to increase the braking force when the contact between the contact pads 151 of the card 101 and the terminals 51 is disrupted and no frictional force is applied to the card 101, it is possible to prevent the card 101 from springing out of the card connector 1.

While a preferred embodiment of the Present Application is shown and described, it is envisioned that those skilled in the art may devise various modifications without departing from the spirit and scope of the foregoing Description and the appended Claims.

What is claimed is:

1. A card connector comprising:

a housing configured to accommodate therein a card which is provided with terminal members;

connection terminals mounted in the housing and configured to be capable of coming into contact with the terminal members of the card;

a card guide mechanism which is provided with a slide member configured to slide while holding therein the card inserted into the housing and an urging member configured to urge the slide member in a direction opposite to an insertion direction of the card, and is configured to hold the card at a lock position thereof to thereby maintain a state where the terminal members of the card are in contact with the connection terminals, and when the card is moved in the insertion direction to reach an over-stroke position thereof by a pushing operation to push the card being held at the lock position in the insertion direction, to thereby move the card in the direction opposite to the insertion direction from the over-stroke position by an urging force of the urging member to be ejected therefrom; and a cover member mounted on the housing and configured to cover at least the slide member and a portion of the card inserted into the housing;

wherein:

the cover member is provided with a cantilever-like brake member which has a base end portion thereof being integrally connected to the cover member and a free end thereof being formed with a sliding portion; and the slide member is provided with a brake-receipt portion containing a braking face capable of permitting the sliding portion to be in close contact therewith, the braking face being formed therein with a plurality of convex portions which is arranged in the insertion direction of the card.

2. The card connector according to claim 1, wherein the braking face contains a top surface of each of the convex portions having a height thereof which changes in an order of low, high, low, high, and low in a direction from a front side in the insertion direction of the card toward an innermost side thereof.

3. The card connector according to claim 2, wherein the braking force to apply a brake to the slide member, which generates when the sliding portion comes into close contact with the braking face, changes in the order of low, high, low, high, and low when the slide member moves in the direction opposite to the insertion direction of the card from the over-stroke position.

4. The card connector according to claim 3, wherein the brake member exerts an elastic force and the sliding portion is pressed against the braking face by the elastic force.

5. The card connector according to claim 4, wherein the sliding portion comes into close contact with a portion of the braking face being located closer to the front side in the insertion direction of the card than the convex portion that is positioned on the frontmost side when the card is positioned at the over-stroke position, and comes into close contact with the top surface of the convex portion that is positioned on the frontmost side when the card is positioned at the lock position.

6. The card connector according to claim 5, wherein when the card is ejected, the slide member comes into tight contact with a stopper portion of the housing and stops, and when the slide member comes into tight contact with the stopper portion and stops, the sliding portion comes into close contact with a portion of the braking face being located closer to the innermost side in the insertion direction of the card than the convex portion that is positioned on the innermost side or comes to be positioned closer to the innermost side in the insertion direction of the card than the brake-receipt portion so as to be in no contact with the braking face.

7. The card connector according to claim 6, wherein when the card is ejected, so that the card is positioned at a position where the connection between the terminal members and the connection terminals is disrupted, the sliding portion comes into close contact with a portion of the braking face which is located between the convex portion that is positioned on the frontmost side and the convex portion that is positioned on the innermost side, and which is not provided with the convex portions.

8. The card connector according to claim 7, wherein when the card is ejected, so that the card is positioned between a position where the connection between the terminal members and the connection terminals is disrupted and a position where the slide member comes into tight contact with a stopper portion of the housing and stops, the sliding portion comes into close contact with a top surface of the convex portion that is positioned on the innermost side in the braking face.

9. The card connector according to claim 8, wherein the urging member comprises a coil spring capable of exerting an urging force upon being compressed.

10. The card connector according to claim 1, wherein the brake member exerts an elastic force and the sliding portion is pressed against the braking face by the elastic force.

11. The card connector according to claim 1, wherein the sliding portion comes into close contact with a portion of the braking face being located closer to the front side in the insertion direction of the card than the convex portion that is positioned on the frontmost side when the card is positioned at the over-stroke position, and comes into close contact with the top surface of the convex portion that is positioned on the frontmost side when the card is positioned at the lock position.

12. The card connector according to claim 1, wherein when the card is ejected, the slide member comes into tight contact with a stopper portion of the housing and stops, and when the slide member comes into tight contact with the stopper portion and stops, the sliding portion comes into close contact with a portion of the braking face being located closer to the innermost side in the insertion direction of the card than the convex portion that is positioned on the innermost side or comes to be positioned closer to the innermost side in the insertion direction of the card than the brake-receipt portion so as to be in no contact with the braking face.

13. The card connector according to claim 1, wherein when the card is ejected, so that the card is positioned at a position where the connection between the terminal members and the connection terminals is disrupted, the sliding portion comes into close contact with a portion of the braking face which is located between the convex portion that is positioned on the frontmost side and the convex portion that is positioned on the innermost side, and which is not provided with the convex portions.

14. The card connector according to claim 1, wherein when the card is ejected, so that the card is positioned between a position where the connection between the terminal members and the connection terminals is disrupted and a position where the slide member comes into tight contact with a stopper portion of the housing and stops, the sliding portion comes into close contact with a top surface of the convex portion that is positioned on the innermost side in the braking face.

15. The card connector according to claim 1, wherein the urging member comprises a coil spring capable of exerting an urging force upon being compressed.

* * * * *